US005341820A

United States Patent [19]

Hammett

[11] Patent Number: 5,341,820

[45] Date of Patent: Aug. 30, 1994

[54] PATIENT TREATMENT APPARATUS INCLUDING A MATTRESS AND A TREATMENT CHAMBER, AND METHOD FOR TREATMENT OF THE PATIENT

[76] Inventor: Anthony Hammett, The Tree Tops, Long Street, Attard, Malta

[21] Appl. No.: 983,484

[22] Filed: Nov. 30, 1992

[51] Int. Cl.[5] ..... A61G 15/00; A47K 3/12

[52] U.S. Cl. ..... 128/845; 4/564.1

[58] Field of Search ..... 128/845; 4/60.1, 64.1, 4/65.1, 66.1, 547, 495, 542, 543

[56] References Cited

U.S. PATENT DOCUMENTS

| | | | |
|---|---|---|---|
| 693,300 | 2/1902 | Müller | 4/560.1 |
| 2,133,587 | 10/1938 | Stark | 4/566.1 |
| 3,477,069 | 11/1969 | Stiger | 4/566.1 |
| 3,561,018 | 2/1971 | McVay | 4/566.1 |
| 3,670,343 | 6/1972 | Gansloser | 4/495 |
| 3,801,995 | 4/1974 | Adamson | 4/564.1 |
| 4,340,039 | 7/1982 | Hibbard | 4/541.6 |
| 5,038,853 | 8/1991 | Callaway | 4/541.1 |
| 5,167,042 | 12/1992 | Holmes | 4/564.1 |

*Primary Examiner*—Michael A. Brown

*Attorney, Agent, or Firm*—Jordan and Hamburg

[57] ABSTRACT

A method an apparatus for therapeutic treatment of a patient, wherein the patient is lowered into a therapeutic bath compartment on a waterproof mattress. The bath may be provided with water jets and a facility for blowing air into the water. The patient is dried in the bath compartment by drying air, prior to raising of the mattress to an upper position above the bath compartment.

16 Claims, 4 Drawing Sheets

PATIENT TREATMENT APPARATUS INCLUDING A MATTRESS AND A TREATMENT CHAMBER, AND METHOD FOR TREATMENT OF THE PATIENT

FIELD OF THE INVENTION

This invention relates to a method and apparatus for treating a patient, and is more in particular directed to a method and apparatus for immersing a patient in a liquid bath and removing the patient therefrom.

BACKGROUND OF THE INVENTION

In the past, various arrangements have been provided for the treatment of a patient in a liquid, such as hot water.

U.S. Pat. Nos. 2,329,326; 4,037,259 and 4,152,792 and U.K. Patent No. 1,389,522 disclose treatment apparatuses wherein a bathing tub may be formed by selectively providing raised side walls around a mattress or otherwise supporting a tub structure on a mattress.

U.S. Pat. Nos. 3,581,322 and 4,037,591 disclose waterproof mattresses or pads.

U.S. Pat. No. 3,965,501 discloses a bathing apparatus wherein the patient is supported on a mattress via a net-like or grate-like plastic member. In order to lower the patient into a tub, for bathing, it is necessary to first remove the mattress from under the plastic member, so that the patient is lowered into a tub while reclining on the plastic member.

U.S. Pat. No. 4,970,736 discloses a bathing apparatus wherein mattress pads are arranged on a frame above a tub, and the frame is movable to a position to enable a patient on the mattress to be moved onto a net. The net can be lowered into the tub with the patient thereon.

U.S. Pat. No. 5,101,519 discloses a bathing arrangement for a patient in which the patient support has three elements configured to place the patient in a sitting position for immersion in a tub.

In addition, an advertisement for an Aqua Massage therapy device, in "Chiropractic Products", October 1990, pages 1 and 12, discloses a therapeutic water massage unit on which a user reclines and is covered by a waterproof sheet. The unit is provided with nozzles to direct water to pulse the waterproof sheet for the length of the body of the user.

SUMMARY OF THE INVENTION

The present invention is directed to the provision of an improvement over the above described treatment devices and methods.

Briefly stated, in accordance with the invention, a therapeutic apparatus is comprised of a waterproof mattress or the like that can be lowered into a compartment or tub of therapeutic liquid, such as warm water. The patient can be dried in the compartment with warm air after the water has been drained therefrom, and raised from the compartment on the mattress. The mattress is a mattress upon which the patient normally reclines, so that the treatment of the patient can be effected with a minimum of movement of the patient.

The tub may be provided with jet nozzles for circulating water in the tub, as well as nozzles for injecting air bubbles in the water. The jetting of water and injection of air bubbles is inhibited unless the mattress is at a lower position within the tub.

The treatment apparatus in accordance with the invention enables therapy to be readily given to anyone of any age and any state of health or age condition, enabling the person to relax and obtain full hospital treatment without necessitating the use of any difficult hospital treatment. The water massage which the device provides may be employed over the whole body, and it can be controlled by the user, if desired, or by other personnel. The treatment can be controlled by timers, if desired.

BRIEF FIGURE DESCRIPTION

In order that the invention may be more clearly understood, it will now be disclosed in greater detail with reference to the accompanying drawings, wherein.

DISCLOSURE OF THE PREFERRED EMBODIMENT OF THE INVENTION

Figure 1:
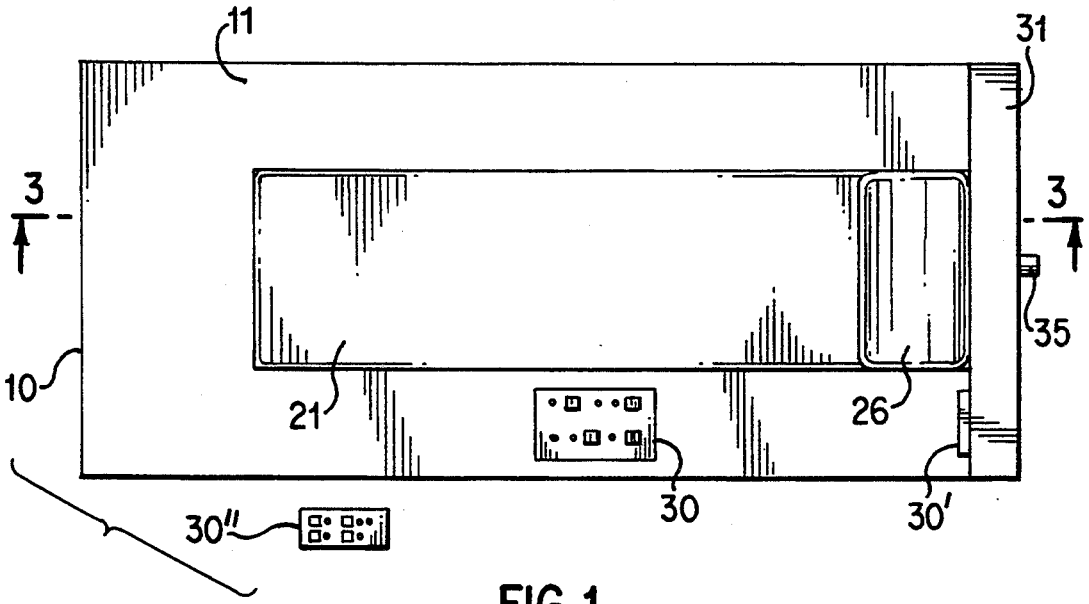
FIG. 1 is a top view of a treatment apparatus in accordance with the preferred embodiment of the invention.

Referring now to the drawings, and more in particular to FIGS. 1–4, a treatment apparatus in accordance with the preferred embodiment of the invention is comprised of a housing 10 defining the bottom, sides, front and back of the apparatus. The housing 10 has a top wall 11 with a large rectangular central aperture therein, and an immersion chamber, such as a tub 12 extends into the housing within the central aperture thereof, the tub being supported by the top wall 12 at the perimeter of the aperture therein. The tub 12 is adapted to hold water therein.

Figure 2:
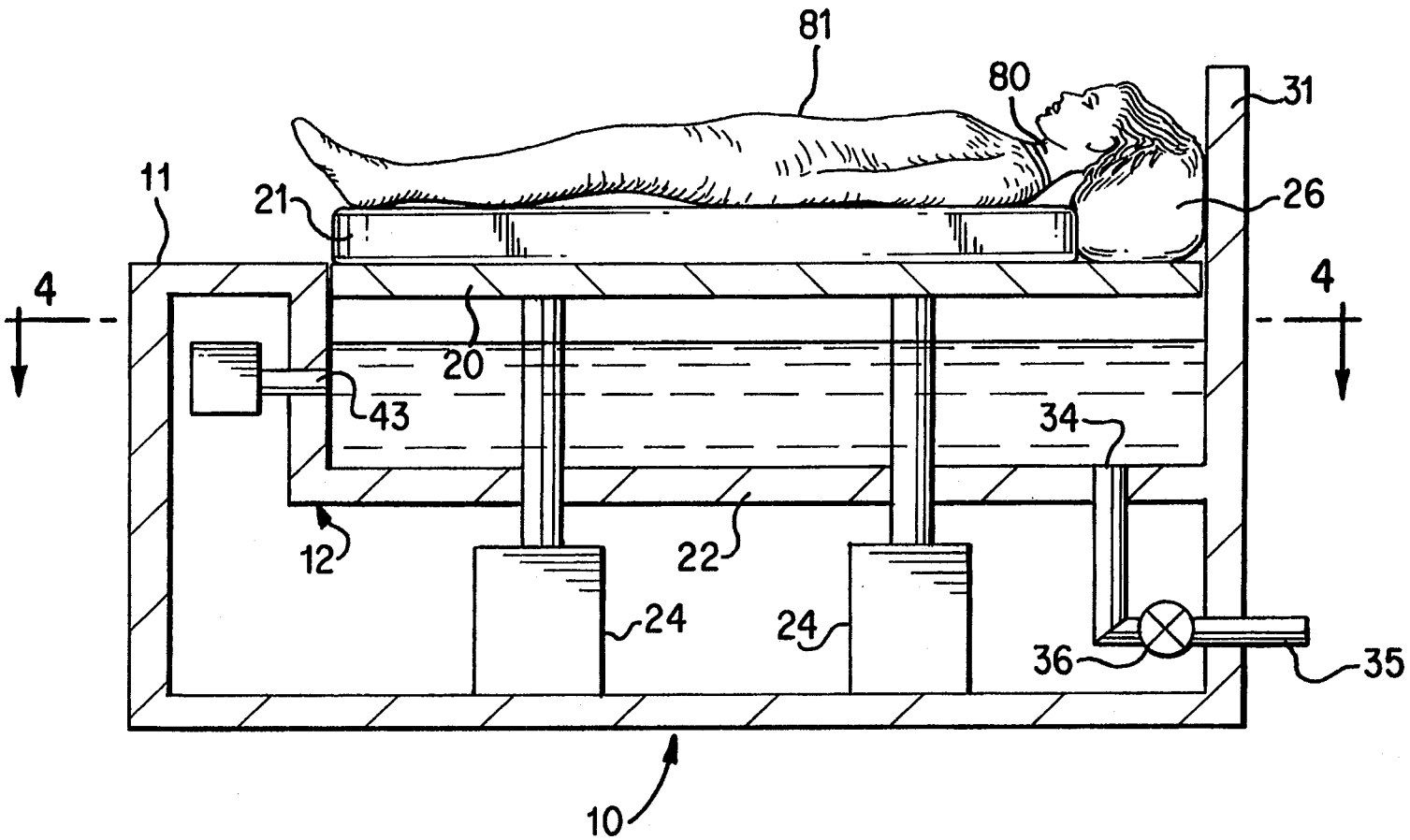
FIG. 2 is a cross-sectional view of the apparatus of FIG. 1, taken in a vertical longitudinal plane thereof.
Figure 3:
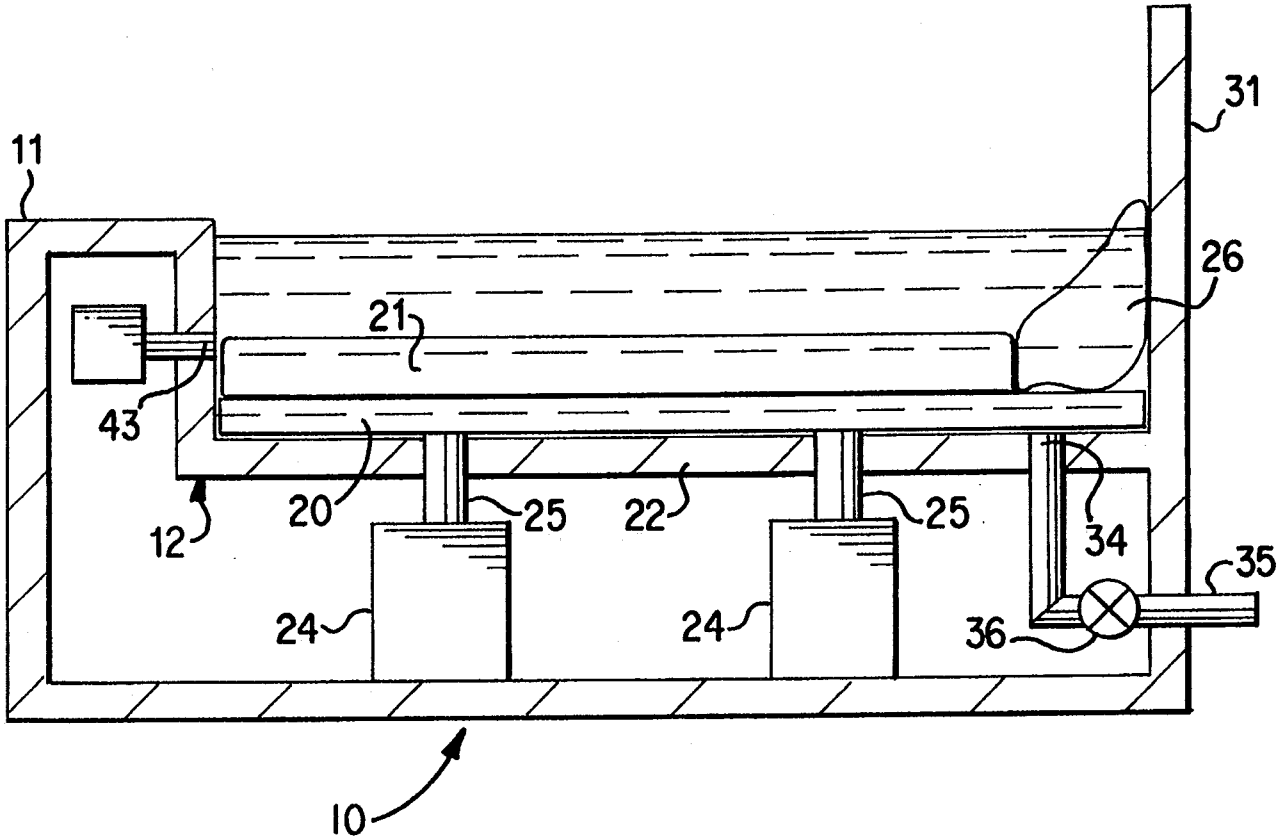
FIG. 3 is a cross sectional view of the apparatus of FIG. 1, taken along the line 3—3.

A rigid mattress support plate 20 is vertically movably positioned in a horizontal plane in the tub 12, having perimeter dimensions slightly less than the internal side wall dimensions of the tub. The support plate is sufficiently rigid to support a waterproof mattress 21 on its upper surface, the mattress having a width substantially equal to that of the plate 20, and a length that may be less that of the support plate. The mattress is of a type that is sufficiently comfortable to constitute a support for the patient also at times during which the mattress is not immersed in the tub, so that it is not necessary to move the patient for the purpose of therapeutic treatment in the tub. The support plate 20 is adapted to be moved from an upper position at which the mattress 21 is at the top of, or slightly above, the top of the wall 11, as illustrated in FIG. 2, and a lower position at which the mattress is close to the bottom wall 22 of the tub. The vertical movement of the plate 20 may be effected by any conventional means. For example, one or more lift mechanisms 24 may be mounted on the bottom of the housing, having lift members 25 extending sealingly through the bottom 22 of the tub, to engage the lower side of the support plate. For example only, the lift mechanisms may be hydraulic lifts, or they may be rack and pinion lifting devices. Suitable conventional controls may be provided to limit the movement of the support plate to the above discussed upper and lower positions. It will of course be apparent that, in the upper position of the support plate, a patient lying on the mattress will be fully out of the tub 12, while in the lower position of the support plate, a patient lying on the matters may be sufficiently deep in the tub to be largely or substantially immersed in a liquid therein.

As further illustrated, an inflatable pillow 26 may be provided at one end of the mattress, whereby the pillow 26 engages a portion of the support plate at a longitudinal end thereof. In addition, as illustrated in FIG. 1, a control panel 30 may be provided on the top wall 11, within the reach of a patient reclining on the mattress. Alternatively, or in addition, a control panel 30' may be provided on an upstanding wall 31 of the housing adjacent the pillow end of the apparatus. It is of course apparent that alternatively, or in addition, the control board may be controlled remotely, for example via a remote control device 30" linked to the control board via conventional radio link, ultrasonic link, laser light link, or other remote control system.

Figure 4:
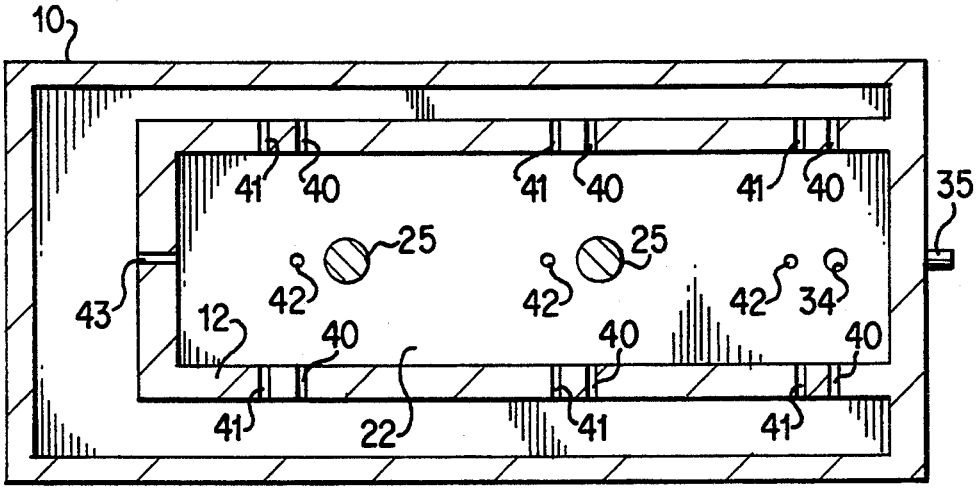
FIG. 4 is a cross-sectional view of the apparatus of FIG. 2, taken along the lines 4—4.

The tub 12 is provided with means for filling the tub with water, for draining the tub, and for directing air into the tub. While these features will described in more detail with reference to FIG. 5, FIGS. 2, 3 and 4 illustrate a drain hole 34 in the bottom 22 of the tub, the drain hole 34 being piped to a suitable drain 35 via a valve 36. In addition, as illustrated in FIG. 4, a plurality of water nozzles 40 are provided in the sidewalls of the tub, for example three of such nozzles in each side wall spaced longitudinally of the tub. A plurality of air nozzles are provided in each sidewall of the tub, for example three of such nozzles being provided in each sidewall spaced in the longitudinal direction of the tub. A plurality of water outlet holes 42 for the jet water system may be provided in the bottom of the tub. Still further, a water inlet hole 43 may be provided in an end wall of the tub. It will be of course understood that the number and placement of holes and nozzles in the tub is not limited to the illustrated embodiment of the invention.

Figure 5:
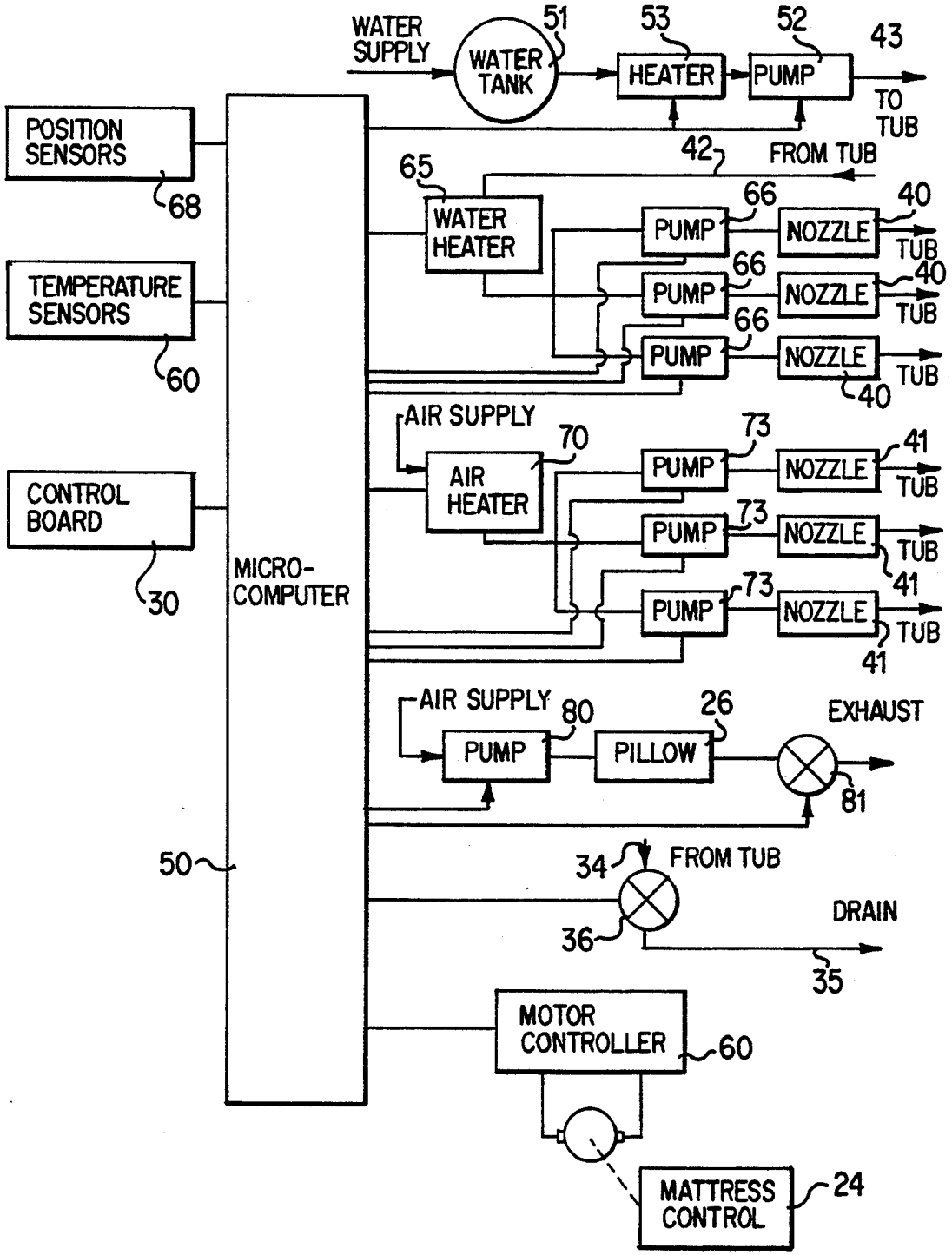
FIG. 5 is a diagram of the control system of the treatment apparatus.

Referring now to FIG. 5, therein is illustrated a control system in accordance with the invention. It is of course apparent that the elements of this control system may be conveniently mounted within the housing 10, externally of the tub 12 therein.

The control system preferably includes a microcomputer 50 or microcontroller of conventional construction, connected to the control board 30 to receive control signals therefrom. The control board 30 may be provided with suitable indicator lights, such as LEDs, controlled by the microcomputer, to indicate the status of the various controlled elements in the system.

In order to fill the tub 12 with water for treatment of a patient, a water tank 51 or water cartridge (not illustrated) may be provided, either externally or internally of the housing. The water tank 51 way be filled via a conventional supply, or it may be filled manually. If a water cartridge is employed, it may be prefilled. Such a cartridge may require a capacity, for example, of 4 to 6 gallons. The provision of the water tank or cartridge enables the apparatus in accordance with the invention to be employed at locations that do not have a reliable continuous water source. As illustrated in FIG. 5, water from the tank 51 is pumped to the tub by a pump 52, via a water heater 53. The operation of the pump 52 and the water heater 53 are controlled by the microcomputer, in order to enable filling of the tub with water of a desired temperature, preferably before immersion of a patient therein.

Water may be drained from the tub 12 via the drain 35, under the control of the valve 36, which may be a solenoid valve. Alternatively, water may be drained into a cartridge (not illustrated) for either reuse or disposal. The microcomputer thus also controls the draining of water from the tub.

In addition, the microcomputer also controls the mattress control device 24, such as an hydraulic lift or rack and pinion mechanism. This control may be effected via a motor controller 60, or other conventional control device for controlling the device 24.

In order to provide water jets in the tub, for therapeutic purposes, water withdrawn from the tub via the holes 42 may be heated in the heater 65 under the control of the microcomputer, the thus heated water then being pumped, via pumps 66, to the water jet nozzles 40. The pumps 66 may be individually controlled by the microcomputer, in order to enable the patient or an attendant to control the water jets separately, or to have them all active in the therapeutic treatment. The different nozzles 40 may be located in the vicinity of the upper portion of the patient's body, at the center of the patient's body and in the leg region of the patient. The invention thus enables the concentration of therapeutic treatment to all of the patient's body, or to selective portions thereof. It is of course apparent that the nozzles may be placed at other positions of the tub 12.

In accordance with a further feature of the invention, the apparatus is provided with position sensors 68 for sensing the positions of the support table 20, the output from the sensors being sensed by the microcomputer to inhibit operation of the pumps 66 unless the support plate 20 is in its lower position. In addition, temperature sensors 69 provide an input to the microcomputer to enable the microcomputer to control the temperature of the water, both the inlet water and the water supplied to the nozzles 40.

The system of the invention further provides means for directing air into the tub 12, for example via the nozzles 41. The air may be introduced into the water to provide a therapeutic effect, such as may be provided by a whirlpool tub, such as of the Jacuzzi brand. The air may also be introduced into the tub after water has been drained therefrom, in order to dry the patient before raising the support plate 20 to its upper position. As illustrated in FIG. 5, external air may be heated by a heater 70, under the control of the microcomputer. Heated air from the heater 70 is directed to the air pumps 73 for application to the air nozzles 41.

As with the water system, the temperature sensors 60 may include an air temperature sensor in order to enable the microcomputer to control the temperature of the air. Similarly, the microcomputer may respond to the outputs of the position sensors 68 to inhibit the energization of the air pumps 73 unless the support plate 20 is in its lower position.

As discussed above, the pillow 26 for the head of the patient is an air filled pillow. In order to ensure that the head of the patient is positioned properly in both the upper and lower positions of the mattress, the microcomputer 50 also controls an air pump 80 directing air into the pillow, and controls a solenoid valve 81 to exhaust the pillow. The control of air in the pillow may be responsive to the position of the mattress, as sensed by the position sensors 68, for example to have a lower pressure when the mattress is in its upper position than when it is in its lower position. The invention is of course not limited to a specific schedule for control for the pressure of air in the pillow.

In accordance with a further feature of the invention, in the event that it is desired to provide the patient with therapeutic treatment without getting the skin of the patient wet, this result may be accomplished by first dressing the patient 80 in waterproof clothing 81, as illustrated in FIG. 2.

Before a treatment in the tub 12, the bedclothes may be removed from the mattress 21, and subsequent the treatment, after the patient is dry, the bed may be remade, in a manner that is conventional in the handling of bedridden or other patients.

The present invention thereby provides a simple and effective method and apparatus for the therapeutic treatment of bedridden or other patients, without requiring the patients to be removed from the bed which he or she normally occupies, and with a minimum of preparation of the patient for the treatment.

It is of course apparent that a portion or all of the treatment of the patient can be controlled automatically by the microcomputer, upon initiation of the treatment at the control board. The internal timers of the microcomputer may thus be employed to control the time of occurrence of each step of the method.

The water that is used in the tub 12 may be ordinary tap water or the equivalent. Alternatively, medically treated water or other treatment liquids may be employed.

While it is preferable to energize the treatment apparatus of the invention via conventional power supply mains, it is apparent that batteries may be employed for this purpose, to enable use of the apparatus in remote areas that do not have a central power source.

While the invention has been disclosed and described with reference to a single embodiment, it will be apparent that variations and modifications may be made therein, and it is therefore the aim of the present invention to cover each such variation and modification as falls within the true spirit and scope of the invention.

What is claimed is:

1. A treatment apparatus for a patient, comprising:
a treatment chamber
a mattress,
means for moving said mattress vertically between a lower position within said chamber and an upper position above said chamber,
means for introducing water in said chamber and removing water from said chamber, and
means for blowing air into said chamber when said mattress is in said lower position for drying a patient on said mattress, in the absence of water in said chamber.

2. The treatment apparatus of claim 1 wherein said mattress is a waterproof mattress, and wherein said means for introducing water in said chamber comprises means for introducing heated water into said chamber.

3. The treatment apparatus of claim 1 further comprising means for circulating water in said chamber.

4. The treatment apparatus of claim 3 wherein said circulating means comprises means for directing jets of water into said chamber.

5. The treatment apparatus of claim 1 wherein said means for blowing air into said chamber also comprises means for blowing air in said chamber when water is filled therein.

6. The treatment apparatus of claim 1 further comprising a water tank, said means for supplying water comprising means for supplying water to said chamber from said tank.

7. The treatment apparatus of claim 1 wherein said means for moving said mattress comprises an hydraulic lift mechanism.

8. The treatment apparatus of claim 1 further comprising a housing surrounding said chamber, whereby a space is provided between said housing and chamber, said means for moving said mattress, means for blowing air and means for introducing water being mounted in said space.

9. The treatment apparatus of claim 1 further comprising means for heating said air and water.

10. A treatment apparatus for a patient, comprising:
a treatment chamber
a mattress,
means for moving said mattress vertically between a lower position within said chamber and an upper position above said chamber,
means for introducing water in said chamber and removing water from said chamber, and
means for blowing air into said chamber when said mattress is in said lower position for drying a patient on said mattress, in the absence of water in said chamber; and
further comprising an air filled pillow on said mattress, and means for varying the pressure of air in said pillow.

11. A treatment apparatus comprising a tub, a waterproof mattress, means for moving said mattress to a lower position within said tub and an upper position adjacent the top of said tub, means for introducing heated water into said tub, means for circulating water in said tub, means for introducing air into said tub for drying a patient on said mattress, in the absence of water in said tub, and means for inhibiting said means for circulating and means for introducing air unless said mattress is in said lower position.

12. The treatment chamber of claim 11 comprising a housing surrounding said tub, whereby a space is provided between said housing and tub, said means for circulating, means for introducing water, means for introducing air and said means for moving said mattress being mounted in said space.

13. A method for treating a patient reclining on a mattress, comprising:
lowering the mattress into a water filled chamber,
circulating water in the chamber while the mattress is immersed therein, then
removing water from the chamber and directing drying air on the patient while the mattress is still in the chamber, and then
raising the mattress from the chamber.

14. The method of claim 13 further comprising directing air into said water during said step of circulating water.

15. The method of claim 13 further comprising dressing said patient in waterproof clothing before lowering said mattress into said chamber.

16. The method of claim 13 comprising inhibiting said step of circulating and said step of directing drying air when said mattress is not lowered into said chamber.

* * * * *